US010935348B2

(12) United States Patent
Liu et al.

(10) Patent No.: US 10,935,348 B2
(45) Date of Patent: Mar. 2, 2021

(54) LOCKING MECHANISM TO SECURE A FIREARM ACCESSORY MOUNT TO A PICATINNY RAIL

(71) Applicants: Haoqian Liu, Oregon City, OR (US); Xiaobo Liu, Zhongshan (CN)

(72) Inventors: Haoqian Liu, Oregon City, OR (US); Xiaobo Liu, Zhongshan (CN)

( * ) Notice: Subject to any disclaimer, the term of this patent is extended or adjusted under 35 U.S.C. 154(b) by 0 days.

(21) Appl. No.: 16/800,372

(22) Filed: Feb. 25, 2020

(65) Prior Publication Data

US 2020/0271423 A1 Aug. 27, 2020

Related U.S. Application Data

(60) Provisional application No. 62/809,841, filed on Feb. 25, 2019.

(51) Int. Cl.
*F41G 11/00* (2006.01)
*F41C 27/00* (2006.01)

(52) U.S. Cl.
CPC ..... *F41G 11/003* (2013.01); *F41C 27/00* (2013.01)

(58) Field of Classification Search
CPC ..... F41G 11/003; F41C 27/00
USPC ..... 42/124–127, 90; 248/187.1
See application file for complete search history.

(56) References Cited

U.S. PATENT DOCUMENTS 5,086,566 A 2/1992 Klumpp
5,107,612 A 4/1992 Bechtel
6,931,778 B1 8/2005 Nelson et al.
7,310,903 B2 12/2007 Kim
7,908,784 B2 3/2011 Kim
8,336,247 B2 12/2012 Haering
8,490,313 B2 7/2013 Frascati et al.
8,510,983 B2 8/2013 Larue
8,857,097 B2 10/2014 Rorick
9,091,508 B2 7/2015 Prieto
9,273,930 B2 3/2016 Jiminez et al.
9,303,955 B2 4/2016 Jeung et al.
9,488,445 B2 11/2016 Houde-Walter
9,506,708 B2 11/2016 Peterson et al.
10,119,788 B2 11/2018 Kennair, Jr.
10,254,085 B2 4/2019 Willmann et al.
10,365,069 B1 7/2019 Tayon et al.
10,393,481 B2 8/2019 Langevin et al.
2008/0040965 A1* 2/2008 Solinsky ..... F41G 1/345 42/90
2012/0181406 A1 7/2012 Gonzalez
(Continued)

FOREIGN PATENT DOCUMENTS

DE 102006024508 B4 * 3/2014 ..... F41G 11/003
EP 3179199 A1 * 6/2017 ..... F41G 11/003

*Primary Examiner* — Reginald S Tillman, Jr.
(74) *Attorney, Agent, or Firm* — Dunlap Bennett & Ludwig, PLLC; Brendan E. Squire

(57) ABSTRACT

A locking mechanism for securely attaching an accessory mount to a firearm having a Picatinny/Weaver mounting rail. The locking mechanism includes a resiliently biased slider jam that is received within a transverse groove of the Picatinny/Weaver rail. A clip is provided to clamp the accessory mount to the rail by a locking screw. A locking screw spring may urge the clip away from a tight engagement with the rail when the locking screw is in a loosened condition. The locking mechanism is adaptable to all Picatinny/Weaver rails and provides a rock solid firearm accessory mounting system.

19 Claims, 3 Drawing Sheets

(56) References Cited

U.S. PATENT DOCUMENTS

| | | | | |
|---|---|---|---|---|
| 2016/0146572 | A1* | 5/2016 | Ley | F41C 27/00<br>42/90 |
| 2019/0234710 | A1 | 8/2019 | Batenhorst et al. | |

* cited by examiner

LOCKING MECHANISM TO SECURE A FIREARM ACCESSORY MOUNT TO A PICATINNY RAIL

CROSS-REFERENCE TO RELATED APPLICATION

This application claims the benefit of priority of U.S. provisional application No. 62/809,841, filed Feb. 25, 2019, the contents of which are herein incorporated by reference.

BACKGROUND OF THE INVENTION

The present invention relates firearms, and more particularly to mounting items to a Picatinny rail.

There are many firearm accessories such as lasers or flashlights that may be attached to a Picatinny/Weaver rail. A traditional locking screw of the mounting mechanism must be fixed and inserted in a transverse slot of the rail, depending on the size and design of the firearm, some firearms, such as a compact pistol have a very short picatinny/weaver rail that does not allow all firearm accessories to fit if the accessories is big.

Previous apparatus to securely attach or install a firearm accessory, such as a laser mount shown in reference to FIG. 3, attach a block/bar on the Picatinny/Weaver rail slot. However, there are different sizes of the block/bar from different laser manufacturers and not all are compatible. The thickness and width of these other bar/block varied so the bar/blocks do not fit all Picatinny/Weaver rails.

As can be seen, there is a need for an improved locking mechanism to allow firearm accessories to securely fit on some firearm that has a smaller or short picatinny/weaver rail.

SUMMARY OF THE INVENTION

In one aspect of the present invention, a locking mechanism for mounting a firearm accessory to a Picatinny/Weaver rail of a firearm is disclosed. The locking mechanism includes an accessory body having opposed rail mounting arms extending along a longitudinal length of the accessory body. The opposed rail mounting arms are configured to engage with the Picatinny/Weaver rail. At least one of the opposed rail mounting arms includes an adjustable arm that can be laterally adjusted to accommodate varying widths of the Picatinny/Weaver rail. A slider jam is resiliently extensible and retractable from a mating surface of the accessory body with the Picatinny/Weaver rail. The slider jam is configured for engagement with a transverse slot defined along a longitudinal length of the Picatinny/Weaver rail.

In some embodiments, the slider jam has a width slightly less than that of the transverse slot.

In other embodiments, a bore is defined in the mating surface to receive the slider jam. A spring is received within the bore to resiliently bias the slider jam to protrude from the mating surface.

In other embodiments, a limiting ring adjustably is carried within the bore to retain the slider jam within the bore. A threaded engagement surface may be defined between the limiting ring and the bore. A shoulder may be defined on a first end of the slider jam that is configured to engage with an interior face of the limiting ring to retain the slider jam in the bore. The limiting ring may also be adjustable such that the slider jam is resiliently biased against a base of the transverse slot when mounted to the Picatinny/Weaver rail.

In some embodiments, a groove is defined along a longitudinal length of the accessory body. The at least one adjustable arm is carried within the groove. A mating surface is defined between the groove and the at least one adjustable arm, such that the mating surface maintains a vertical and a longitudinal alignment of the at least one adjustable arm as it is laterally adjusted.

In other embodiments a locking screw laterally extends through the adjustable arm for attachment of the adjustable arm to the accessory body. A locking screw spring is disposed to bias the adjustable arm laterally outwardly from the accessory body. A recess may be defined in the mating surface of the adjustable arm and a first end of the locking spring carried within the recess. The recess may have a depth to receive a length of the locking spring when the mating surface of the adjustable arm is positioned in abutment with the mating surface of the groove.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provide an apparatus and method for reliably securing a firearm accessory mount to a Picatinny/Weaver rail. The improved locking mechanism includes a spring slider jam, which can be adjusted to different lengths and fits variously sized rail slots for all Picatinny/Weaver rails.

Figure 1:
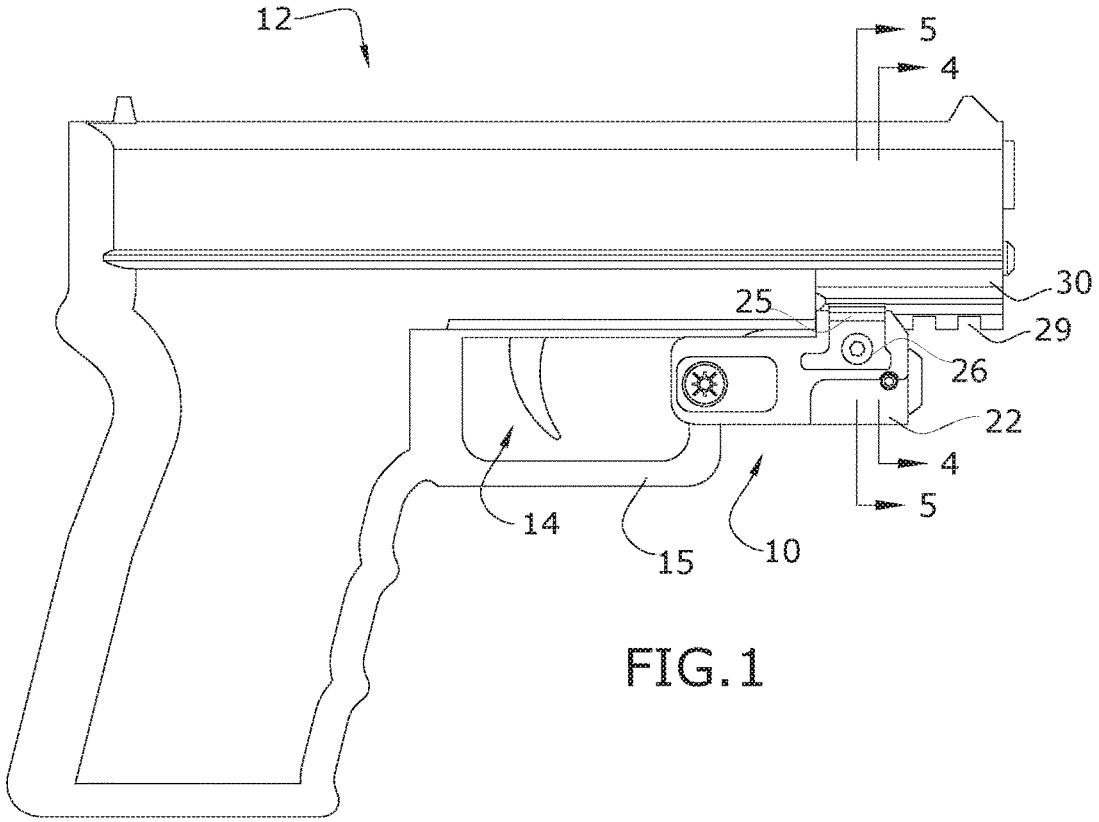
FIG. 1 is a side view of an accessory mount assembly shown in-use.
Figure 2:
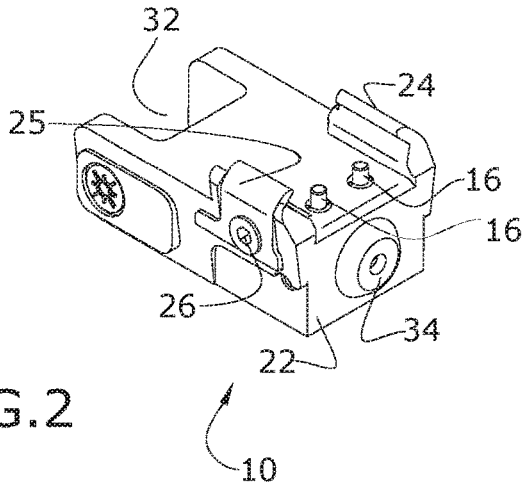
FIG. 2 is a top front perspective view of the accessory mount assembly.
Figure 3:
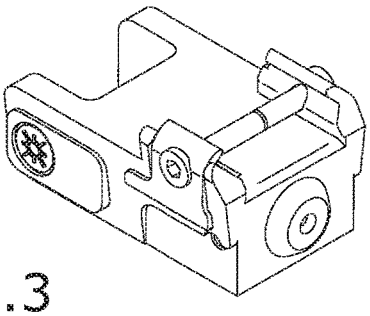
FIG.3 (PRIOR ART)
FIG. 3 is a prior art top front perspective view.
Figure 4:
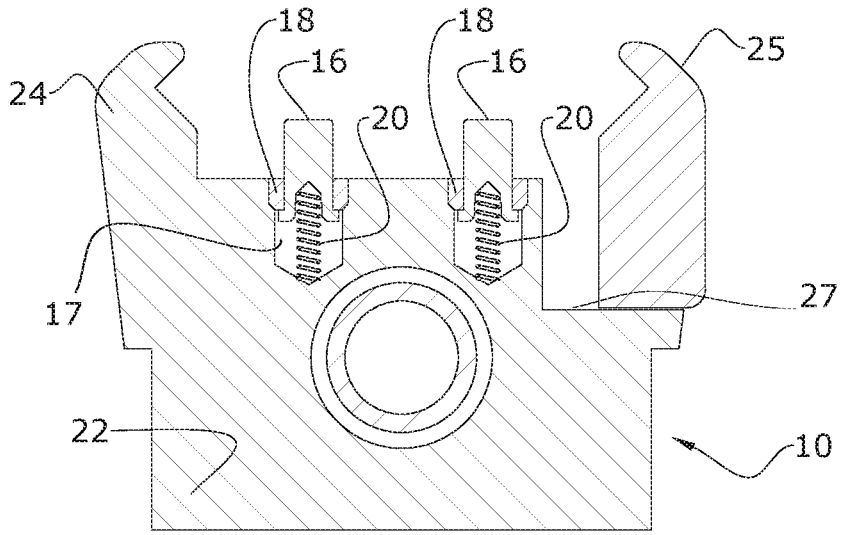
FIG. 4 is a section view taken along line 4-4 of FIG. 1.
Figure 5:
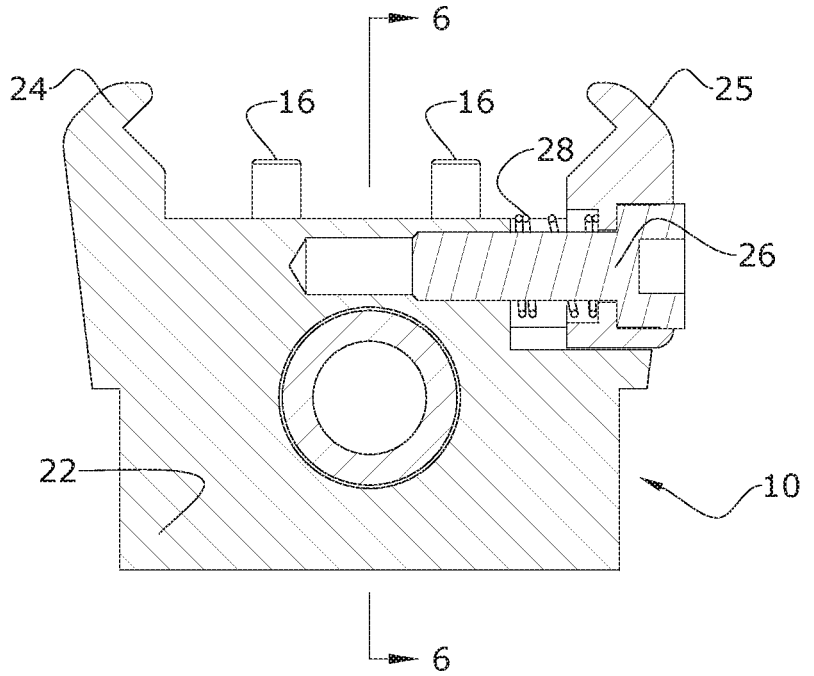
FIG. 5 is a section view taken along line 5-5 of FIG. 1.
Figure 6:
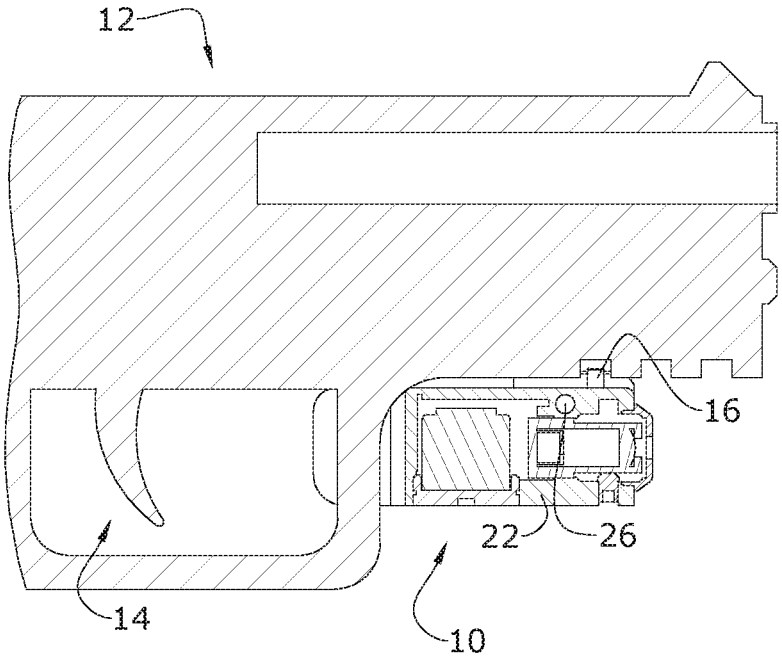
FIG. 6 is a section view taken along line 6-6 of FIG. 5 with slide jam in an engaged position.
Figure 7:
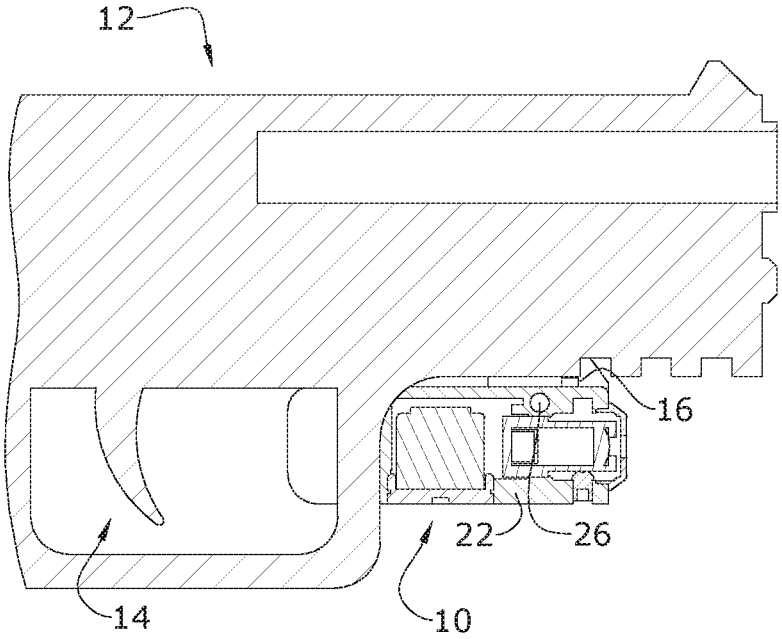
FIG. 7 is a section view taken along line 6-6 of FIG. 5 with slide jam in a disengaged position.

As seen in reference to the drawings of FIG. 1, a firearm accessory assembly 10, such as a laser sight 34, is configured to be mounted to a Picatinny/Weaver rail 30 of a firearm 12, such as a handgun. The Picatinny/Weaver rail 30 includes a plurality of transverse slots 29 extending across the rail 30 in a spaced apart manner. The firearm 12 is fired by activation of a trigger 14 that is protected from an accidental discharge by a trigger guard 15 that extends in a loop between a handgrip or stock of the firearm 12 and a barrel of the firearm 12.

The firearm accessory assembly 10 includes opposed rail mounting arms 24, 25 extending along a longitudinal length of an accessory body 22 of the accessory assembly 10. The opposed rail mounting arms 24, 25 are configured to engage with and secure the accessory assembly 10 to the Picatinny/Weaver rail 30. At least one of the opposed rail mounting arms 24, 25 includes an adjustable arm 25 that can be laterally adjusted to accommodate mounting the accessory assembly 10 to varying widths of the Picatinny/Weaver rail 30.

A slider jam 16 is provided to secure the firearm accessory assembly 10 at any of a plurality of transverse slots 29 defined along a longitudinal length of the Picatinny/Weaver rail 30. The slider jam 16, which may be a round bar or a square rod with a step or a shouldered end is received within a bore 17 extending into the accessory body 22. The slider jam 16 may be formed of a copper alloy, a carbon steel, a stainless steel or a plastic material. A maximum diameter of the slider jam 16 is slightly less than the width of the transverse slot 29 defined in the Picatinny/Weaver rail 30 in order to limit longitudinal displacement of the accessory body 22 when the firearm 12 is discharged.

A limiting ring 18 may be a threaded ring that adjustably restricts movement of the slider jam 16 from within the bore 17. The limiting ring 18 material may be copper alloy, carbon steel, stainless steel or plastic. A spring 20 is provided to resiliently bias the slider jam 16 in an outward direction from bore 17. The spring 20 material may carbon steel, stainless steel, or other suitable resilient material. The limiting ring 18 may be adjusted such that the slider jam 16 is resiliently biased against a base of the transverse slot 29 with which it is aligned for mounting the accessory assembly 10.

The accessory body 22 is the main part of the accessory assembly 10 and has the corresponding bore 17 for the spring 20, the limiting ring 18, and the slider jam 16 in a mating surface of the accessory body. A groove 27 is defined along at least a portion of the accessory body 22 and is dimensioned to receive the adjustable arm 25 and a threaded transverse hole for fixing a locking screw 26 on the side. A precision mating surface between the groove 27 and the adjustable arm 25 ensure proper vertical and longitudinal alignment of the adjustable arm 25 with the Picatinny/Weaver rail 30 as the adjustable arm 25 is carried in the groove 27. The accessory body 22 material may be an aluminum alloy or a plastic.

The adjustable arm 25 has a protruding end which is precisely matched with the accessory body 22 to ensure that the adjustable arm 25 is not tilted when locked. The adjustable arm 25 may be made of an aluminum alloy or a plastic material.

The locking screw 26 can lock the adjustable arm 25 and the outer casing tightly to the components of the rail 30. The locking screw material can be a carbon steel or a stainless steel.

A locking screw spring 28 is beneficial for the adjustable arm 25 to be urged outwardly from the accessory body 22 when the locking screw 26 is loosened.

The spring 20 is received in a hole defined in the bottom of the accessory body 22. The slider jam 16 may then be placed on the spring 20, and the limiting ring 18 is screwed into the accessory body 22 such that the shoulder of the slider jam 16 retains the slider jam in the hole. The limiting ring 18 is settable to retain the slider jam 16 at a desired extension from the hole, corresponding to a depth of the transverse slot 29 in the rail 30. The locking screw 26 passes through the spring 7 and then through a hole of the adjustable arm 25. The locking screw 26 and threads into the accessory body 22, to tightly fix the adjustable arm 25 to the accessory body 22 and the gun rail 30.

The slider jam 16, the limiting ring 18, the spring 20, and the accessory body 22 form an elastic mechanism that moves the slider jam 16 up and down along the hole of the bottom of the accessory body 22. When the outer rail is loaded, the bottom of the rail 30 will give the slider jam 16 the pressure to overcome the bias force of the spring 20 for the slider jam 16 to be urged into the hole. Once the position of the slider jam 16 moves to the top of the transverse slot 29, the spring 20 pushes the slider jam 16 into the rail transverse slot 29 to prevent the sight from falling off of the gun 12.

The accessory body 22, the locking screw 26, the adjustable arm 25 and the locking screw spring 28 form a mechanism for tightly securing the accessory assembly 10 to the Picatinny/Weaver rail 30. The accessory body 22, the gun rail 30, and a protruding end of the adjustable arm 25 helps to ensure the adjustable arm 25 stays vertical and tight.

Considering that a lock screw or a lock screw and a fixing block are commonly used in the market, these fix the position of the sight to the gun rail and many sights can be limited to individual types of guns. This commonality leads to a poor fit that can lead to loosening of the accessory after the firearm has been discharged.

The locking mechanism of the present invention, with resiliently or spring biased slider jam 16 can solve this problem, allowing the user to mount the accessory 10 anywhere on the Picatinny/Weaver rail 30, making it easier for the user to open, switch, or adjust the overall position or effect of the accessory 10. A notch 32 may be defined at an aft end of the accessory body 22 to accommodate a forward end of the trigger guard 15.

Preferably, the adjustable arm 25 is carried on a, is provided for the adjustable arm 25 to be closely matched with the accessory body 22. This ensures that the adjustable arm 25 is not tilted when it is locked which affects the appearance and accuracy. The user can mount the accessory 10 with the locking mechanism on the rail 30 of the firearm 12 and place the slider jam 16 between the trigger guard 15 and any transverse slot 29 of the Picatinny/Weaver rail 30, or in any other transverse slot 29, then lock the locking screw 26, so that the adjustable arm 25 securely engages the rail 30 while maintaining the proper orientation of the accessory 10.

It should be understood, of course, that the foregoing relates to exemplary embodiments of the invention and that modifications may be made without departing from the spirit and scope of the invention.

What is claimed is:

1. A locking mechanism for mounting a firearm accessory to a Picatinny/Weaver rail of a firearm, comprising:

an accessory body having opposed rail mounting arms extending along a longitudinal length of the accessory body, the opposed rail mounting arms configured to engage with the Picatinny/Weaver rail;

at least one of the opposed rail mounting arms includes an adjustable arm that can be laterally adjusted to accommodate varying widths of the Picatinny/Weaver rail;

a slider jam comprises at least one pin resiliently extensible and retractable from a corresponding at least one axially aligned bore defined in a mating surface of the accessory body with the Picatinny/Weaver rail, the at least one pin configured for engagement with a transverse slot defined along a longitudinal length of the Picatinny/Weaver rail; and a spring received within the bore to resiliently bias the slider jam to protrude from the mating surface, and a limiting ring adjustably carried within the bore to retain the slider jam within the bore.

2. The locking mechanism of claim 1, wherein the at least one pin has a width slightly less than a width of the transverse slot.

3. The locking mechanism of claim 1, further comprising:

a limiting ring adjustably carried within the bore to retain the slider jam within the bore, the limiting ring settable to retain the slider jam at a desired extension from the bore, corresponding to a depth of the transverse slot in the Picatinny/Weaver rail.

4. The locking mechanism of claim 3, further comprising:

a threaded engagement surface between the limiting ring and the bore.

5. The locking mechanism of claim 4, further comprising:

a shoulder defined on a first end of the slider jam configured to engage with an interior face of the limiting ring to retain the slider jam in the bore.

6. The locking mechanism of claim 3, wherein the limiting ring is adjustable such that the slider jam is resiliently biased against a base of the transverse slot.

7. The locking mechanism of claim 1, further comprising:

a groove defined along a longitudinal length of the accessory body;

the adjustable arm carried within the groove; and a mating surface defined between the groove and the adjustable arm, the mating surface maintaining a vertical and a longitudinal alignment of the adjustable arm as it is laterally adjusted.

8. The locking mechanism of claim 7, further comprising:

a locking screw laterally extending through the adjustable arm for attachment of the adjustable arm to the accessory body.

9. The locking mechanism of claim 8, further comprising:

a locking screw spring disposed to bias the adjustable arm laterally outwardly from the accessory body.

10. The locking mechanism of claim 9, further comprising:

a recess defined in the mating surface of the adjustable arm; and a first end of the locking screw spring carried within the recess.

11. The locking mechanism of claim 10, wherein the recess has a depth to receive a length of the locking screw spring when the mating surface of the adjustable arm is positioned in abutment with the mating surface of the groove.

12. The locking mechanism of claim 1, further comprising:

a laser sight carried within the accessory body.

13. A locking mechanism for mounting a firearm accessory to a Picatinny/Weaver rail of a firearm, comprising:

an accessory body having opposed rail mounting arms extending along a longitudinal length of the accessory body, the opposed rail mounting arms configured to engage with the Picatinny/Weaver rail;

at least one of the opposed rail mounting arms includes an adjustable arm carried within a groove defined along the longitudinal length of the accessory, a mating surface defined between the groove and the adjustable arm, the mating surface maintaining a vertical and a longitudinal alignment of the adjustable arm as it is laterally adjusted to accommodate varying widths of the Picatinny/Weaver rail; and a slider jam resiliently extensible and retractable from a mating surface of the accessory body with the Picatinny/Weaver rail, the slider jam configured for engagement with a transverse slot defined along a longitudinal length of the Picatinny/Weaver rail.

14. The locking mechanism of claim 13, further comprising:

a locking screw laterally extending through the adjustable arm for attachment of the adjustable arm to the accessory body.

15. The locking mechanism of claim 13, further comprising:

a locking screw spring disposed to bias the adjustable arm laterally outwardly from the accessory body.

16. The locking mechanism of claim 15, further comprising:

a recess defined in the mating surface of the adjustable arm; and a first end of the locking screw spring carried within the recess.

17. The locking mechanism of claim 13, wherein the slider jam has a width slightly less than a width of the transverse slot.

18. The locking mechanism of claim 13, further comprising:

a bore defined in the mating surface to receive the slider jam; and a spring received within the bore to resiliently bias the slider jam to protrude from the mating surface.

19. The locking mechanism of claim 18, further comprising:

a limiting ring adjustably carried within the bore to retain the slider jam within the bore.

* * * * *